US008434647B2

(12) United States Patent
Aamar

(10) Patent No.: US 8,434,647 B2
(45) Date of Patent: May 7, 2013

(54) DEVICE FOR MEASURING AND DISPENSING A PRESCRIBED AMOUNT OF LIQUID

(76) Inventor: Riad Aamar, Litchfield, CT (US)

( * ) Notice: Subject to any disclaimer, the term of this patent is extended or adjusted under 35 U.S.C. 154(b) by 387 days.

(21) Appl. No.: 12/836,088

(22) Filed: Jul. 14, 2010

(65) Prior Publication Data

US 2011/0031279 A1 Feb. 10, 2011

Related U.S. Application Data

(60) Provisional application No. 61/232,421, filed on Aug. 8, 2009.

(51) Int. Cl.
*B65D 37/00* (2006.01)
*G01F 11/28* (2006.01)

(52) U.S. Cl.
USPC ..... 222/207; 222/211; 222/205; 222/440

(58) Field of Classification Search ..... 222/207, 222/211, 205, 434, 438, 440
See application file for complete search history.

(56) References Cited

U.S. PATENT DOCUMENTS

| | | | | | |
|---|---|---|---|---|---|
| 2,979,236 | A | | 4/1961 | Fahr | |
| 3,141,579 | A | * | 7/1964 | Medlock | 222/207 |
| 3,705,668 | A | * | 12/1972 | Schwartzman | 222/207 |
| 4,057,177 | A | | 11/1977 | Laauwe | |
| 4,180,106 | A | * | 12/1979 | Coetzee | 141/294 |
| 4,314,657 | A | * | 2/1982 | Perakis et al. | 222/162 |
| 4,427,041 | A | * | 1/1984 | Coetzee | 141/294 |
| 4,972,977 | A | * | 11/1990 | Moss et al. | 222/207 |
| 5,174,478 | A | | 12/1992 | Reyman | |
| 5,833,124 | A | * | 11/1998 | Groves et al. | 222/158 |
| 6,186,367 | B1 | | 2/2001 | Harrold | |
| 6,241,129 | B1 | * | 6/2001 | Bonningue et al. | 222/213 |
| 6,341,718 | B1 | * | 1/2002 | Schilthuizen et al. | 222/207 |
| 6,343,716 | B1 | * | 2/2002 | Baudin et al. | 222/207 |
| 6,406,207 | B1 | | 6/2002 | Wiegner et al. | |
| 6,484,906 | B2 | * | 11/2002 | Bonningue | 222/207 |
| 7,331,489 | B2 | | 2/2008 | Glynn et al. | |
| 7,549,816 | B2 | | 6/2009 | Glynn et al. | |
| 7,959,045 | B2 | * | 6/2011 | Kuge et al. | 222/495 |
| 8,136,701 | B2 | * | 3/2012 | Veltrop et al. | 222/207 |
| 2003/0047570 | A1 | | 3/2003 | Masuda | |

FOREIGN PATENT DOCUMENTS

| | | |
|---|---|---|
| WO | WO-2008-000480 | 1/2008 |

* cited by examiner

*Primary Examiner* — Kevin P Shaver
*Assistant Examiner* — Nicholas Weiss
(74) *Attorney, Agent, or Firm* — Leason Ellis LLP

(57) ABSTRACT

The present invention discloses a device for measuring and dispensing a prescribed amount of liquid. The advantage of the present device is that a simple squeezing action not only reliably and precisely stores a prescribed volume of liquid (e.g., a liquid cooking ingredient, beverage (such as wine or liquor) but then subsequently upon an additional squeeze, discharges the stored liquid while refilling the dose chamber with another dose of the prescribed volume to be later discharged upon the next squeezing action. This eliminates the time consuming tasks of having to measure liquids with conventional measuring cups and the like and instead, the user simple initially adds liquid to the container and then places the cover and measuring and dispensing mechanism on top of the container prior to performed successive squeezing for loading and discharging the dose volume.

18 Claims, 4 Drawing Sheets

DEVICE FOR MEASURING AND DISPENSING A PRESCRIBED AMOUNT OF LIQUID

CROSS REFERENCE TO RELATED APPLICATION

The present invention claims the benefit of U.S. patent application Ser. No. 61/232,421, filed Aug. 8, 2009, which is hereby incorporated by reference in its entirety.

TECHNICAL FIELD

The present invention relates to measuring and dispensing devices and in particular, to device that measures and dispenses a precise amount of liquid in a simple manner to allow the device to be used in the kitchen and other locations.

BACKGROUND

There are a number of different applications where it is important to measure a precise amount of liquid for subsequent dispensing. For example and one of the most common applications that most encounter every day is the art of cooking. Generally speaking, cooking is the process of preparing food by applying heat, selecting, measuring and combining ingredients in an ordered procedure for producing tasty, edible food. The process encompasses a vast range of methods, tools and combinations of ingredients to alter the flavor, appearance, texture, or digestibility of food. The ingredients used to make a dish (food) can be either solid, such as wheat, or can be liquid.

In yet another common application, the measuring and dispensing of an amount of liquid is also important in the beverage and bar business where certain cocktails call for certain amounts of spirits that are in effect ingredients of the cocktail. For example, a "seabreeze" cocktail is created by measuring an amount of vodka and adding it to an amount of cranberry juice. There are hundreds of different types of cocktails that each requires different amounts of liquids (spirits) to be measured and combined.

In both of these environments and other similar environments, the most common traditional manner of measuring an amount of liquid and then dispensing it is to use a measuring cup. However, this can be a time consuming task since it requires the use of a measuring cup that has gradations relating to different volume measurements of liquid (i.e., ¼ cup, ½ cup, etc.). The manner of measuring the liquid can be imprecise in that the user pours liquid from the base stock container into the measuring cup until the meniscus of the liquid reaches the target gradation. As most will be familiar with, it is difficult to precisely obtain the target amount of liquid since a pour or successive pours from the stock container often results in either too little or too great an amount of liquid being transferred into the measuring cup. This imprecise process can lead to waste and at the very least is a time consuming, menial task that reduces the grandeur of cooking.

SUMMARY

The present invention discloses a device for measuring and dispensing a prescribed amount of liquid. The advantage of the present device is that a simple squeezing action not only reliably and precisely stores a prescribed volume of liquid (e.g., a liquid cooking ingredient, beverage (such as wine or liquor) but then subsequently upon an additional squeeze, discharges the stored liquid while refilling the dose chamber with another dose of the prescribed volume to be later discharged upon the next squeezing action. The device delivers a perfect measure every time! This eliminates the time consuming tasks of having to measure liquids with conventional measuring cups and the like and instead, the user simple initially adds liquid to the container and then places the cover and measuring and dispensing mechanism on top of the container prior to performed successive squeezing for loading and discharging the dose volume.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
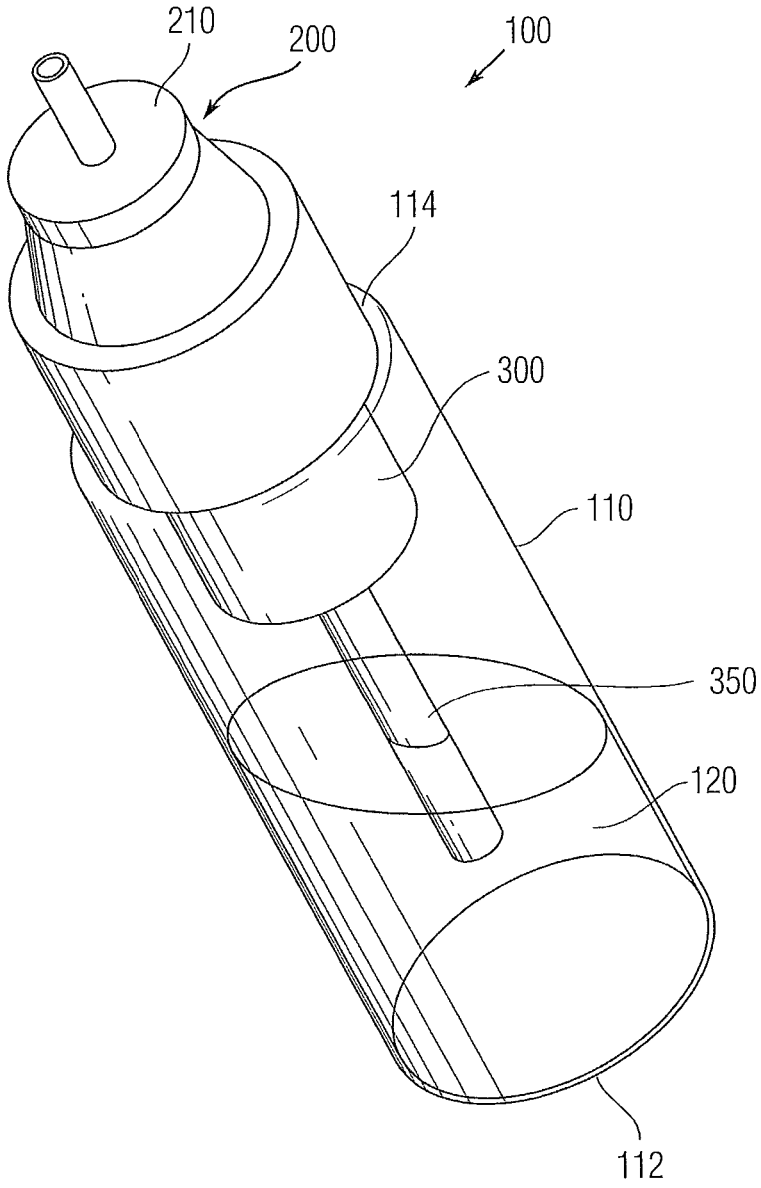
FIG. 1 is a top and side perspective view of a fluid measuring and dispensing device according to one embodiment of the present invention.
Figure 2:
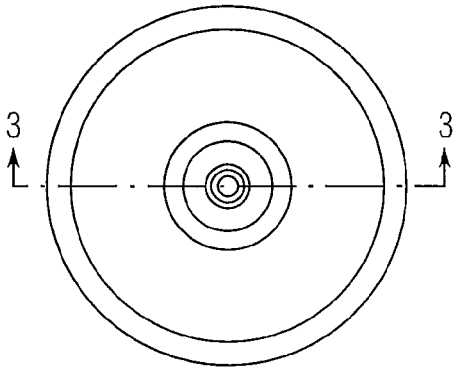
FIG. 2 is a top plan view of the fluid measuring and dispensing device of FIG. 1.

In accordance with a first embodiment of the present invention, a fluid measuring and dispensing device 100 is illustrated. The measuring and dispensing device 100 includes a container or receptacle 110 that holds and stores a liquid 120. The container 110 includes a first closed end 112 and an opposite second open end 114. The container 110 can be formed of any number of different materials including suitable plastics. The container 110 can be formed in different sizes and contain different volumes of fluid. The container 110 can be transparent or translucent in nature to allow the liquid to be visible. In the illustrated embodiment, the container 110 has a neck 120 that is located proximate the second open end 114.

The device 100 has a measuring and dispensing mechanism 200 that is configured to be removably attached to the container 100 in a sealed manner. The mechanism 200 includes a number of components that are assembled together. More specifically, the mechanism 200 includes a cap or cover 210 that is sealingly coupled to the container 110 so as to close the second open end 114 of the container 110. Any number of different methods of attaching the cover 210 to the container 110 can be used including the creation of a frictional fit or threadingly attaching the cover 210 to the container 110. For example, the illustrated cover 210 is a hollow body structure that includes a base portion 212 that has a circumferential side wall 214 that includes an inner surface or wall 215. The illustrated cover 210 has a center body portion 220 that has an opening 222 formed at a distal end thereof. The body portion 220 is integrally formed with the base portion 212 and extends upwardly from the base portion 212 with the hollow interior of the cover 210 communicating with the opening 222.

The cover 210 can be attached to the container 110 by a frictional fit as by sliding the inner surface of the base portion 212 over the neck of the container 110. The frictional coupling results in the cover 210 being sealed to the container 110. Alternatively, the inner surface of the base portion 212 can includes threads that engage complementary threads that are formed on outer surface of the upstanding neck of the container 110.

Figure 3:
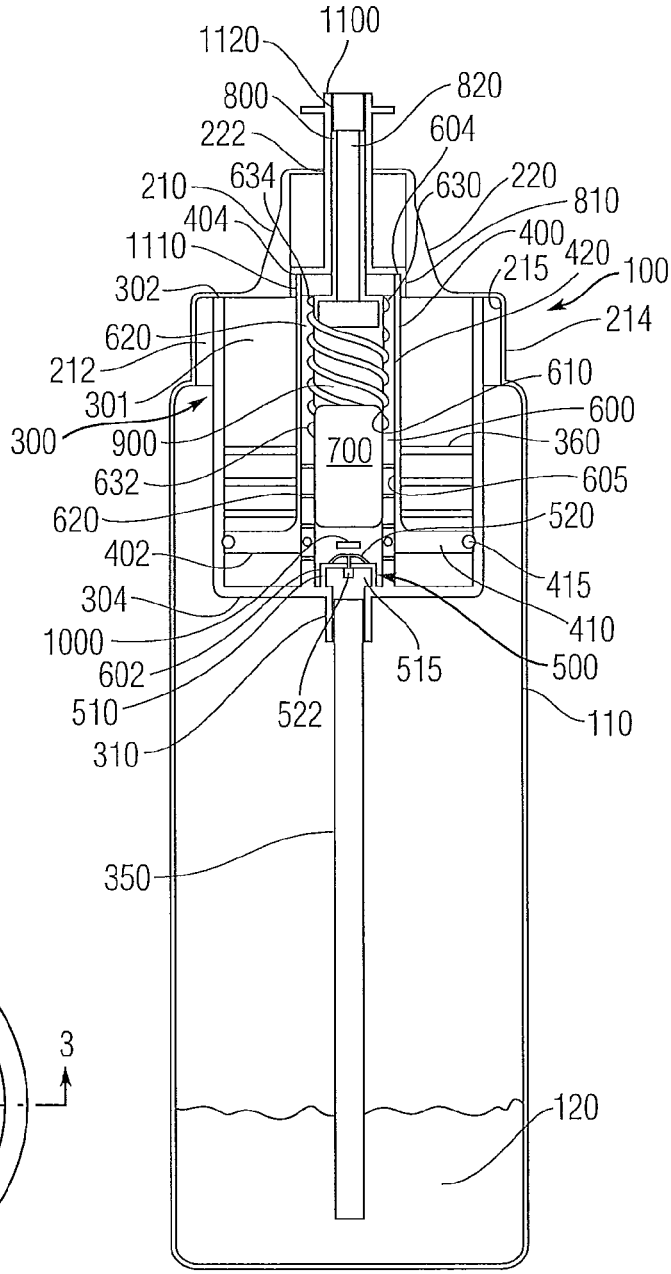
FIG. 3 is a cross-sectional view taken along the line 3-3 of FIG. 2.

The body portion 220 has smaller dimensions than the dimensions of the base portion 212. As shown in FIG. 3, the base portion 212 is a hollow structure defining a first circular interior space that has a circular shape and the body portion 220 is a hollow structure that has a hollow second interior space (circular space) that is in direct fluid communication with the first interior space. Both the first and second interior spaces can have substantially continuous diameters along the respective heights thereof. The outer surface of the body portion 220 can define a slight taper in the direction toward the opening 222; however, it will be appreciated that the outer surface of the body portion 220 can have a continuous diameter along its length (height).

The cover 210 can thus be a single molded hollow structure.

The device 100 further includes a dose chamber 300 that has a first end 302 and an opposing second end 304. The dose chamber 300 is a hollow structure that is generally cup-shaped and defines an interior compartment 301. In particular, the second end 304 includes a first port 310 in the form of an annular shaped tube that extends from the second end 304 of the dose chamber 300. The first port 310 can be centrally located along the bottom surface (second end 304) of the dose chamber 300. The first port 310 forms an entrance into the hollow interior compartment 301 defined by the dose chamber 300. The first end 302 is an open end.

The first end 302 can include a locking flange or lip that engages a complementary feature in the cover 210 to result in the secure attachment between the dose chamber 300 and the cover 210. For example, a frictional fit or a snap-fit type fit can be formed between the dose chamber 300 and the cover 210.

An inner surface of the side wall of the dose chamber 300 includes a plurality of spaced gradations or markings 360 that are spaced apart from the first end 302 to the second end 304. For example, the inner surface can include a series of spaced annular markings (grooves or channels) 360 that are indicative of different volume measurements of the dose chamber 300. For example, the bottommost marking 360 could represent and indicate a volume of 1 ounce; the next marking 360 could represent and indicate a volume of 2 ounces, etc. The use of the markings 360 will be described hereinafter.

A hollow capillary tube 350 or the like is coupled to the first port 310. For example, the hollow interior conduit of the tube 350 is in fluid communication with the hollow interior of the dose chamber 300. The interior of the tube 350 is in direct fluid communication with the first valve assembly 500. The other end of the tube 350 is spaced from the bottom of the container 110.

In accordance with the present invention, the measuring and dispensing mechanism 200 includes an adjustable plunger-like structure 400 that is sealingly received within the interior of the dose chamber 300. More specifically, the adjustable plunger structure 400 includes a distal end 402 and a proximal end 404. The distal end 402 of the plunger 400 includes a flange 410 (annular shaped flange) that is sealingly engaged about its periphery to an inner surface of the dose chamber 300. For example, a seal member 415 (e.g., O-ring or gasket) can be provided along the outer periphery of the flange 410 (e.g., within a groove formed in the outer periphery). The seal member 415 creates a fluid seal between the plunger 400 and the inner surface of the dose chamber 300.

The plunger structure 400 also includes an elongated hollow body 420 that extends from the flange 410 toward the proximal end 404. The body 420 can have a tubular shape that is open at each end and as shown in FIG. 3, the flange 410 has a central opening (e.g., a circular opening) formed therein that extends along a length thereof.

In addition, the dose chamber 300 has a valve assembly 500 associated therewith that is configured to selectively permit fluid flow into the dose chamber. In particular, the valve assembly 500 includes a valve support 510 and a movable valve member 520. The valve support 510 can be integrally formed with a floor of the dose chamber 300. The valve support 510 includes at least one opening or space 515 that is in fluid communication with the first port 310 to allow liquid contained within the interior of the container 110 to flow through the first port 310 and through the valve assembly 500. The valve support 510 elevates the valve member 520 from the floor of the dose chamber 300. The movable valve member 520 is in the form of a one-way valve and can be a one-way flap valve or the like. The valve member 520 can include a center post 522 that is securely attached to the valve support 510 for mounting the valve member 520 to the valve support 510. Peripheral edges of the valve member 520 flex under pressure, thereby opening up one or more passages that lead to the space 515 that is in fluid communication with the first port 310.

It will therefore be appreciated that the valve member 520 is constructed so that it only opens when a force is applied to its underside which faces the space 515 as when liquid from the container 110 is delivered through the first port 310 and into the space 515 of the valve assembly 500.

The first port 310 of the dose chamber 300 is in fluid communication with the valve assembly 500 so that liquid can flow through the first port 310 and through the valve assembly 500 when it is in an open position.

The dose chamber 300 also includes a central conduit member 600 that is integrally formed with the dose chamber 300. The conduit member 600 is a tubular structure that has a first end 602 and an opposing second end 604 and has a hollow interior (conduit) 605 that extends the length thereof As shown in FIG. 3, the first end 602 is integrally formed with the floor of the dose chamber 300 and the height of the conduit member 600 is equal to or less than the height of the side wall of the dose chamber 300. In other words, the second end 604 of the conduit member 600 is below the top edge of the dose chamber 300. The conduit member 600 can have a cylindrical shape and is thus an upstanding member that is perpendicularly oriented relative to the floor of the dose chamber 300.

The valve assembly 500 is disposed within the interior hollow space defined by the conduit member 600 near the first end 602.

The conduit member 600 has an inner surface 610 and an opposing outer surface 611. In accordance with the present invention, the conduit member 600 has a number of surface flow features. The conduit member 600 has a plurality of fluid openings 620 that pass through the conduit member 600 to provide communication between and the hollow interior 605 and the exterior of the conduit member 600. In accordance with one embodiment of the present invention, the openings 620 are located at prescribed, spaced locations along the length of the conduit member 600. It will be appreciated that each opening 620 can be either a single opening (e.g., hole or slot) formed in the conduit member 600 or it can be two or more openings formed in the conduit member 600 and lying within a single plane that is traverse to the conduit member 600. In other words, the opening 620 can be a pair of slots that are formed 180 degrees from one another but within the same plane.

The openings 620 are carefully formed at select locations from one another and are preferably spaced apart so that one opening 620 is formed per a single dose chamber volume as described below. More specifically, there is at least one opening 620 that is formed between adjacent spaced markings 360. Consequently, each opening 620 forms an entrance from the hollow interior 605 of the conduit member 600 to one dose chamber volume. As previously, mentioned, the dose markings 360 define different, prescribed volumes of the dose chamber 300 and consequently, to fill the dose chamber 300 which a predetermined amount of liquid, the liquid is delivered into the dose chamber until the measured amount of liquid reaches the appropriate marking 360, thereby indicating the desired amount of liquid is contained within the dose chamber 300. The markings 360 thus represent fill lines.

The plunger 400 is moved along the inner wall of the dose chamber 300 in order to define the target volume of liquid to be delivered into the dose chamber 300. For example, if the first marking represent a 1 ounce volume in the dose chamber 300 and the user wants to measure and then deliver 1 ounce of liquid, the plunger 400 is adjusted longitudinally within the dose chamber 300 until the flange 410 is set at a position that represents 1 fluid ounce. In this position, the flange 410 is aligned with the corresponding 1 ounce marking 360 and the underside of the flange 410 is located slightly offset from (above) the opening 620, thereby causing the opening 620 to in free communication with the 1 ounce fluid volume space that is defined within the dose chamber 300 underneath the underside of the flange 410.

Similarly, if the second marking represent a 2 ounce volume in the dose chamber 300 and the user wants to measure and then deliver 2 ounces of liquid, the plunger 400 is adjusted longitudinally within the dose chamber 300 until the flange 410 is set at a position that represents 2 fluid ounces. In this position, the flange 410 is aligned with the corresponding 2 ounces marking 360 and the underside of the flange 410 is located slightly offset from (above) another opening 620, thereby causing the opening 620 to in free communication with the 2 ounces fluid volume space that is defined within the dose chamber 300 underneath the underside of the flange 410. It will therefore be appreciated that as the plunger 400 is pulled from the proximal end of the device 100, the flange 410 slides along the inner surface of the dose chamber 300 until the flange (seal member thereof) engages the appropriate marking 360 and at least two different sets of openings 620 are in fluid communication with the dose chamber 300.

It will be appreciated that the markings 360 can have a completely circumferential shape in that they extend completely around the inner surface of the dose chamber 300 or they can have an arcuate shape in that each does not extend completely around the inner surface.

The markings 360 can be grooves (e.g., annular grooves) formed in the inner wall of the dose chamber 300 and therefore, as the flange 410 slides and encounters a groove 360, the seal 415 of the flange 410 slides into engagement with the groove 360. The user can feel such engagement and this tactile feedback (also possible audible feedback) indicates to the user that the flange 410 is engaged in the dose volume setting that is represented by the marking 360.

When the flange 410 is set into engagement with markings 360 above the bottommost marking 360, it will be appreciated that plural openings 620 that occupy different transverse planes are in fluid communication with the dose chamber 300 defined underneath an underside of the flange 410. Only when the flange 410 is in the bottommost marking 360 is the opening(s) 620 leading into the dose chamber 300 limited to being within a single transverse plane.

The conduit member 600 also includes flow passages 630 that are formed on the inner surface 610. The flow passages 630 are open in select conditions as described below to allow fluid to flow therein along a length of the conduit member 600. The flow passages 630 can be in the form of recessed channels or grooves that are formed along select areas of the ironer surface 610. In the illustrated embodiment, the flow passages 630 are in the form of helical (spiral) shaped channels that are formed within the inner channel 610 beginning at an entrance 632 and terminating in an exit 634. The entrance 632 is a location that is above the last opening(s) 620, while the exit 634 is at the second end 604. The flow passages 630 extend continuously and uninterruptedly from the entrance 632 which represents an entrance into the flow passages 630 to the exit 634 that represents an exit for the fluid.

When the plunger 410 is mounted about the conduit member 600, the conduit member 600 is sealingly received within the central opening (conduit) of the plunger 400 such that the plunger 400 can slide over the outer surface of the conduit member 600. It will be appreciated that the number of openings 620 that are sealed with the elongated body 420 of the plunger 400 depends upon which "setting" (marking 360) the plunger 400 is positioned at in order to deliver the corresponding amount of liquid. Likewise, as described above, the number of openings 620 that are not closed off by the plunger depends upon the setting of the plunger.

The measuring and dispensing mechanism 200 further includes a second valve member 700 that is disposed within the conduit 605 of the conduit member 600. The second valve member 700 is designed to selectively open the flow passages 630 and permit liquid to flow to the exit (second end) of the conduit member 600. The second valve member 700 thus moves between a closed or sealed position where the entrance 632 to the flow passages 630 is sealed and an open position where both the entrance 632 and exit 634 of the flow passages 630 are open to permit liquid to both enter the flow passages 630 and flow to the exit 634 where the liquid exits the conduit member 600.

The second valve member 700 is in the form of an object that sealingly engages the inner wall of the conduit member 600, while being permitted to slidingly travel therealong. For example, the second valve member 700 can be a ball shaped or cylindrical shaped member that is sealed against the inner surface of the conduit member 600. Thus, when a force is applied to the underside (one end) of the valve member 700, movement within the conduit 605 is permitted and once the valve member 700 clears each opening 620, the opening 620 becomes open and similarly, once the valve member 700 clears the first location or end 632 of the flow passages 630, the flow passages 630 become open and liquid can enter therein.

The measuring and dispensing mechanism 200 also includes an exit conduit 800 that is in the form of an elongated hollow structure. The exit conduit 800 has a first end and an opposing second end and in one embodiment, is a tubular structure having a first section 810 that has a first diameter and a second section 820 that has a second diameter. The first diameter is greater than the second diameter and therefore, the first section 810 has a cup shaped appearance. The first end is fixedly disposed within the conduit member 600 with the second section 820 extending therefrom.

The exit conduit 800 is fixed in position relative to the other parts of the mechanism. The exit conduit 800 extends through the center opening formed in the 210 and therefore, when dispensing an amount of liquid, the liquid flows within the exit conduit 800 through the cover 210.

The mechanism 200 includes a biasing mechanism 900 that is disposed within the conduit 605 of the conduit member 600 for biasing the second valve member 700. The biasing mechanism 900 can be in the form of a spring that has a first end that is securely disposed within the first section 810 and an opposite end that extends into the conduit 605 and faces the second valve member 700. The biasing mechanism 900 does not obstruct the flow of the liquid through the conduit 605. For example, in a coil spring embodiment, the liquid can flow up the center of the coil spring into the exit conduit and then through the hollow interior (conduit) of the exit conduit.

There is a stop 1000 located within the conduit 605 for limiting the degree of travel of the second valve member 700. Liquid flow passages are formed around the stop 1000 for permitting liquid to flow into contact with portions of the underside of the stop 1000 to apply a sufficient force thereagainst for movement thereof. The stop 1000 is located above the first valve assembly 500.

The measuring and dispensing mechanism 200 also includes an adjustable handle 1100 for varying the amount of the selected dose. The handle 1100 has a shape similar to the exit conduit 800 and is in the form of an elongated hollow structure. The handle 1100 has a first end and an opposing second end and in one embodiment, is a tubular structure having a first section 1110 that has a first diameter and a second section 1120 that has a second diameter. The first diameter is greater than the second diameter and therefore, the first section 1110 has a cup shaped appearance.

The handle 1100 is fixedly attached to the plunger 400 (hollow body 420) such and therefore, movement of the handle 1100 is translated into longitudinal movement of the plunger 400 within the dose chamber 300. Consequently, the target dose volume is selected by adjusting (pulling or pushing) the handle 1100 until the flange 410 is engaged within the proper marking 360 (channel or groove), thereby indicating that the volume of the dose chamber below the flange 410 equals the target dose volume.

The handle 1100 is disposed about the exit conduit 800 with the elongated second section 820 being disposed within the hollow interior of the second section 820 such that the handle 1100 can slidingly travel over the fixed second section 820.

It will also be appreciated that another set of markings or gradations can be formed on the outer surface of the adjustable handle 1100 to easily inform the user of the current selected dose volume. For example, annular shaped markings 1200 can be formed on the outer surface of the handle 1100. To change the available dose volume of the chamber 300, the user simply moves the handle 1100 until the appropriate marking 1200 is aligned with the top of the cover 210.

The operation of the device 100 will now be described. As previously mentioned, the device 100 is a single device that accurately and easily both measures a volume of liquid and then subsequently dispenses this volume of liquid.

First, the handle 1100 is manipulated until the flange 410 engages the proper groove (channel) 360 thereby indicating that the proper dosing volume has been selected. Next, the container 110 is squeezed to cause liquid container therein to be drawn into the interior of the capillary tube 350. The liquid that is drawn into the tube 350 enters the dose chamber 300 into contact with the one way valve member 520. This force applied to the underside of the valve member 520 causes an opening of the valve member 520 (e.g., peripheral edges of the valve member 520 lift up). The liquid flows through the open opening(s) 620 and into the dose chamber 300. The dose chamber 300 is filled and since the dose chamber 300 volume has been properly selected by the user, the target volume of liquid is therefore measured and contained in the dose chamber 300. In other words, if the user adjusts the plunger 400 to select a one ounce dose chamber volume, a first squeezing action (first application of force) causes one ounce of liquid to be collected within the dose volume chamber.

After the liquid has been measured and contained in the preselected dose volume chamber 300, the user then squeezes (second application of force) the container 110 a second time causing more liquid to be drawn into the tube 350. This second application of force causes two events to occur. First, the liquid that is contained within the dose chamber is expelled out of the conduit member 600 and the exit conduit 800. More specifically, the expelled liquid from the dose chamber 300 flows into the conduit 605 and applies a force against the underside of the second valve assembly 700 to cause the second valve member to slide within the conduit 605 a sufficient distance until the entrance 632 of the flow passage 630 is opened due to the valve assembly 700 clearing the entrance 632, thereby opening up the entrance 632 to the liquid contained in the conduit 605.

When the flow passage 630 is opened, the expelled liquid can flow around the second valve member.

The second squeezing action thus expels the liquid stored in the dose chamber 300 into the conduit 605. The force applied by the liquid against the second valve member 700 causes the second valve member to travel within the conduit 605 until it contacts the biasing member 900 which then applies a counterforce against the second valve member 700 to cause the second valve member to travel back toward the first valve assembly 500 and the stopper 1000. This counterforce action results in the closing of the flow passage 630.

The second result of the second squeezing action is the replenishment or refilling of the dose chamber 300. In other words, the second squeezing action causes the stored dose volume to be expelled out of the dose chamber 300 and out of the entire device 100 and also result in refilling of the dose chamber. The process is then repeated again by squeezing the container 110 again.

The advantage of the present device is that a simple squeezing action not only reliably and precisely stores a prescribed volume of liquid (e.g., a liquid cooking ingredient, beverage (such as wine or liquor) but then subsequently upon an additional squeeze, discharges the stored liquid while refilling the dose chamber with another dose of the prescribed volume to be later discharged upon the next squeezing action. This eliminates the time consuming tasks of having to measure liquids with conventional measuring cups and the like and instead, the user simple initially adds liquid to the container and then places the cover and measuring and dispensing mechanism on top of the container prior to performed successive squeezing for loading and discharging the dose volume.

Figure 4:
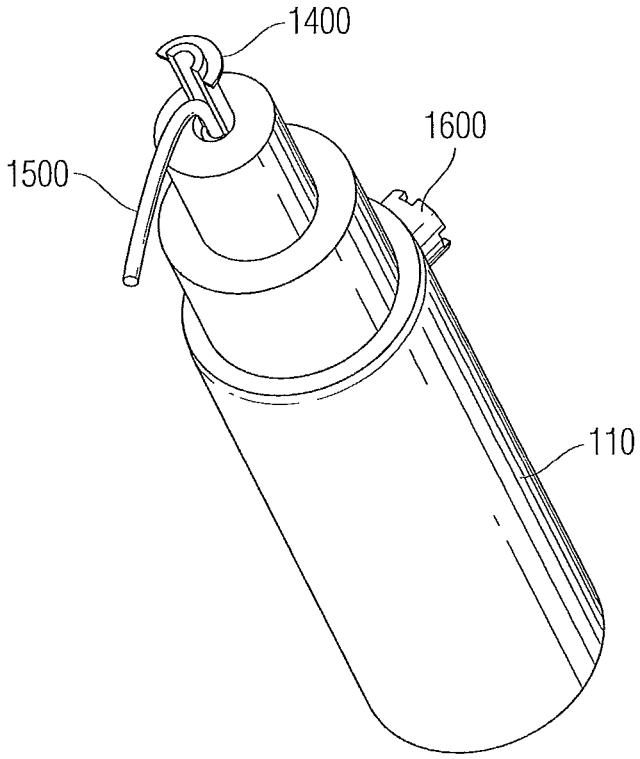
FIG. 4 is a top and side perspective view of a fluid measuring and dispensing device according to another embodiment of the present invention.
Figure 5:
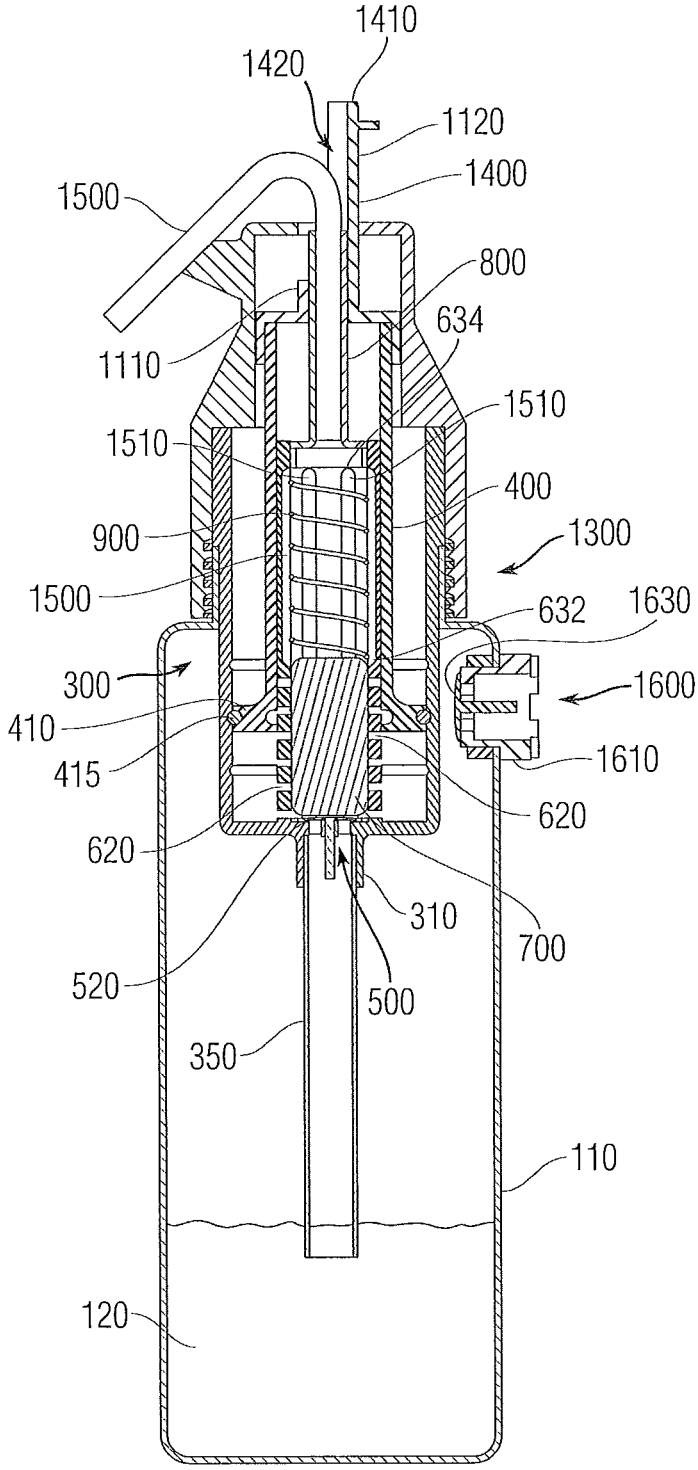
FIG. 5 is a cross-sectional view of the device of FIG. 4.

Now referring to FIGS. 4 and 5 which disclose a fluid measuring and dispensing device 1300 is illustrated. The device 1300 is very similar to the device 100 and therefore like components are numbered alike.

The measuring and dispensing mechanism of the device 1300 includes an adjustable handle 1400 for varying the amount of the selected dose. The handle 1400 is similar to handle 1100. The second section 1120 of the handle 1400 is not a complete tubular structure along its entire length but instead the second section 1120 has a semi-circular shaped wall 1410 that extends to the end of the second section 1120. At the interface between the first and second sections 1110, 1120, the first section 1110 does include a tubular portion 1420. As shown in FIGS. 4 and 5, a straw 1500 is inserted into the central bore (opening) of the handle 1100 and the open slot formed by removal a length of the handle 1400 provides an opening or slot 1420 through which the straw 1500 can extend and be bent and flexed.

The device 1300 also has a conduit member 1500 that is similar to conduit member 600 except for the below differences. The conduit member 1500 also includes flow passages 1510 that are formed on the inner surface of the conduit member 1500. The flow passages 1510 are open in select conditions as described below to allow fluid to flow therein along a length of the conduit member 1500. In this embodiment, the flow passages 1510 are in the form of linear channels or grooves that are formed along select areas of the inner surface of the conduit member 1500. In the illustrated embodiment, the linear flow passages 1510 are formed along the inner surface beginning at an entrance 632 and terminating in an exit 634. The entrance 632 is a location that is above the last opening(s) 620, while the exit 634 is at the second end 604. The flow passages 1510 extend continuously and uninterruptedly from the entrance 632 which represents an entrance into the flow passages 630 to the exit 634 that represents an exit for the fluid.

When the plunger 410 is mounted about the conduit member 600, the conduit member 600 is sealingly received within the central opening (conduit) of the plunger 400 such that the plunger 400 can slide over the outer surface of the conduit member 1500. It will be appreciated that the number of openings 620 that are sealed with the elongated body 420 of the plunger 400 depends upon which "setting" (marking 360) the plunger 400 is positioned at in order to deliver the corresponding amount of liquid. Likewise, as described above, the number of openings 620 that are not closed off by the plunger depends upon the setting of the plunger.

The device 1300 also includes a vent mechanism 1600 that is formed in the container 110 and in particular, the vent mechanism 1600 is formed in the side wall of the container 110. The vent mechanism 1600 includes a valve housing 1610 that mates with an opening 1620 formed in the side wall of the container 110 (alternatively, the valve housing 1610 is integral with the side wall of the container 110). The valve housing 1610 is a hollow structure that extends outwardly from the exterior face of the side wall of the container 110 and can contain space for placing an advertisement or logo, etc. The vent mechanism 1600 includes a valve member 1630 that is operatively disposed within the valve housing 1610 and moves between an open position in which atmospheric air is permitted to flow into the interior of the container 110 and a closed position in which air is prevented from flowing into the interior. In one exemplary embodiment, the valve member 1630 is a one-way valve that opens to let air flow into the container.

The device 1300 operates in the same manner as how the device 100. First, the handle 1400 is manipulated until the flange 410 engages the proper groove (channel) 360 thereby indicating that the proper dosing volume has been selected. Next, the container 110 is squeezed to cause liquid container therein to be drawn into the interior of the capillary tube 350. The liquid that is drawn into the tube 350 enters the dose chamber 300 into contact with the one way valve member 520. This force applied to the underside of the valve member 520 causes an opening of the valve member 520 (e.g., peripheral edges of the valve member 520 lift up). The liquid flows through the open opening(s) 620 and into the dose chamber 300. The dose chamber 300 is filled and since the dose chamber 300 volume has been properly selected by the user, the target volume of liquid is therefore measured and contained in the dose chamber 300. In other words, if the user adjusts the plunger 400 to select a one ounce dose chamber volume, a first squeezing action (first application of force) causes one ounce of liquid to be collected within the dose volume chamber. The vent mechanism 1600 allows air to flow into the container 110 during the squeezing action to permit the container 110 to restore its shape after the squeeze is completed.

After the liquid has been measured and contained in the preselected dose volume chamber 300, the user then squeezes (second application of force) the container 110 a second time causing more liquid to be drawn into the tube 350. This second application of force causes two events to occur. First, the liquid that is contained within the dose chamber is expelled out of the conduit member 1500 and the exit conduit 800. More specifically, the expelled liquid from the dose chamber 300 flows into the conduit 605 and applies a force against the underside of the second valve assembly 700 to cause the second valve member to slide within the conduit 605 a sufficient distance until the entrance 632 of the linear flow passages 1510 is opened due to the valve assembly 700 clearing the entrance 632, thereby opening up the entrance 632 to the liquid contained in the conduit 605.

When the linear flow passages 1510 are opened, the expelled liquid can flow around the second valve member 700.

The second squeezing action thus expels the liquid stored in the dose chamber 300 into the conduit 1500. The force applied by the liquid against the second valve member 700 causes the second valve member to travel within the conduit 1500 until it contacts the biasing member 900 which then applies a counterforce against the second valve member 700 to cause the second valve member to travel back toward the first valve assembly 500 and the stopper 1000. This counterforce action results in the closing of the linear flow passages 1510.

As with the first squeezing action, air flows through the vent mechanism 1600 into the interior of the container 110.

The second result of the second squeezing action is the replenishment or refilling of the dose chamber 300. In other words, the second squeezing action causes the stored dose volume to be expelled out of the dose chamber 300 and out of the entire device 100 and also result in refilling of the dose chamber. The process is then repeated again by squeezing the container 110 again.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A device for measuring and dispensing a prescribed volume of liquid comprising:

a container having an interior compartment for storing the liquid;

a dispensing mechanism including:

a first conduit member for receiving liquid from the interior compartment of the container;

a dose chamber member having a first port at a second end thereof that is in fluid communication with the first conduit member;

an adjustable plunger member that is movably disposed within an interior of the dose chamber member, the plunger member having a flange that sealingly seats against an inner wall of the dose chamber, wherein a dose storage space is formed between an underside of the flange and the second end of the dose chamber for receiving the prescribed volume of liquid from the interior compartment of the container, a hollow second conduit member disposed within a hollow core of the plunger member, the second conduit member having at least one opening that communicates with the dose storage space, the second conduit member having a hollow interior defined by an inner wall that defines an inner conduit in communication with the dose storage space, the inner wall including inner flow channels formed therein;

a first valve member at the first port that is movable between an open position that permits liquid from the interior compartment of the container to flow into the dosage storage space and a closed position; and a second valve member movably disposed within the inner conduit of the second conduit member, wherein movement of the second valve member to a first open position results in fluid communication between the inner conduit and the dosage storage space to permit liquid from the interior compartment of the container to be stored within the dosage storage space and wherein movement of the second valve member to a second open position results in opening of the inner flow channels such that liquid contained within the dosage storage space can flow into and along the inner flow channels to an exit port where the liquid is dispensed from the device, wherein in the second open position fluid communication between the inner conduit and the dosage storage space is provided.

2. The device of claim 1, wherein the container comprises a flexible squeeze bottle.

3. The device of claim 1, wherein the second valve member is biased to a closed position by means of a biasing member that is disposed within the inner conduit of the second conduit member.

4. The device of claim 3, wherein the biasing member comprises a spring disposed within the inner conduit member of the second conduit member.

5. The device of claim 1, wherein the first and second valve members move in response to liquid flowing into and within the first conduit member based on the container being squeezed.

6. The device of claim 1, wherein the dose chamber member comprises a cup shaped member with the first port being formed in a floor of the dose chamber member and an inner surface of the dose chamber member includes a plurality of annular shaped locating members that are formed in series along the height of the dose chamber member, with each locating member representing a marker for defining different volumes of the dose storage space.

7. The device of claim 6, wherein the first conduit member is fittingly received within a boss formed on an underside of the cup shaped member, the boss being formed around the first port.

8. The device of claim 6, wherein each locating member is in the form of an annular shaped groove that receives a seal ring of the plunger for releasably retaining the plunger in a position.

9. The device of claim 1, wherein the first valve member is a one way valve and the second valve member is a ball valve.

10. The device of claim 1, wherein the inner flow channels comprise helically shaped grooves.

11. The device of claim 1, wherein the inner flow channels comprise linear grooves.

12. The device of claim 1, wherein the second conduit member has a plurality of openings located in series along the length of the second conduit member, wherein in the closed position, the second valve member closes off all of the openings.

13. The device of claim 1, wherein the inner flow channels are open at one end of the second conduit member to permit liquid within the inner flow channels to be discharged from the second conduit member and delivered to an exit port.

14. The device of claim 1, wherein an application of force to the container causes the first and second valve members to move.

15. The device of claim 1, wherein the container includes a vent assembly that includes a one way valve that permits air to flow into the interior compartment of the container.

16. The device of claim 1, wherein the adjustable plunger member is coupled to a movable handle and is accessible to a user.

17. The device of claim 1, wherein the dispensing mechanism is incorporated into a removable cover that is coupled to an open end of the container.

18. A bottle for measuring and dispensing a prescribed volume of liquid comprising:

a base container having an interior compartment for storing the liquid;

a dispensing mechanism that is coupled to the base container and includes:

a hollow dose chamber member having a second port at a first end thereof for receiving liquid from the interior compartment;

an adjustable plunger member that is movably disposed within an interior of the dose chamber member, the plunger member having a flange that sealingly seats against an inner wall of the dose chamber, wherein a dose storage space is formed between an underside of the flange and the second end of the dose chamber for receiving the prescribed volume of liquid from the interior compartment of the container, an elongated hollow conduit member disposed within a hollow core of the plunger member, the conduit member being open at first and second ends thereof, wherein a central opening is formed in the conduit member and is defined by an inner wall and extends between and is open at the first and second ends, the inner wall including at least one opening formed therein that communicates with the dose storage space, the inner wall including inner flow channels formed therein, wherein the inner flow channels are located above the at least one opening;

a first valve member at the first port that is movable between an open position and a closed position, wherein in the open position, liquid can flow from the interior compartment of the container into the dosage storage space; and a second valve member movably disposed within the central opening of the second conduit member, wherein in a closed position, the second valve member closes off both the at least one opening and the inner flow channels and in a first open position, the at least one opening is opened and fluid communication is provided between the interior compartment of the container and the dosage storage space and in a second open position, both the at least opening and the inner flow channels are open and in fluid communication with the interior compartment of the container, the inner flow channels being open such that liquid contained within the dosage storage space can flow into and along the inner flow channels to an exit port where the liquid is dispensed from the bottle.

* * * * *